US009754473B1

(12) United States Patent
Chen

(10) Patent No.: US 9,754,473 B1
(45) Date of Patent: Sep. 5, 2017

(54) AUTOMOTIVE ON-BOARD DIAGNOSTIC COMPUTER SYSTEM WITH AUDIOVISUAL GUIDING FUNCTION

(71) Applicant: SHU TE UNIVERSITY, Kaohsiung (TW)

(72) Inventor: Shi-Huang Chen, Kaohsiung (TW)

(73) Assignee: Shu Te University, Kaohsiung (TW)

( * ) Notice: Subject to any disclaimer, the term of this patent is extended or adjusted under 35 U.S.C. 154(b) by 0 days.

(21) Appl. No.: 15/191,859

(22) Filed: Jun. 24, 2016

(51) Int. Cl.
*G08B 21/18* (2006.01)
*G07C 5/00* (2006.01)

(52) U.S. Cl.
CPC ..... *G08B 21/18* (2013.01); *G07C 5/00* (2013.01); *G07C 2205/02* (2013.01)

(58) Field of Classification Search
CPC ..... G08B 21/18; G06F 17/00; G07C 5/00; G07C 5/0808; G07C 2205/02; H04H 20/63; H04N 21/2143
See application file for complete search history.

(56) References Cited

U.S. PATENT DOCUMENTS 5,989,098 A * 11/1999 Reynolds ..... G09F 27/00 40/455
2002/0032876 A1* 3/2002 Okagaki ..... B60R 25/102 713/300
2008/0151126 A1* 6/2008 Yu ..... H04N 5/4403 348/734
2008/0208403 A1* 8/2008 Bertosa ..... G07C 5/0808 701/31.4
2010/0302260 A1* 12/2010 De Lissandri ..... H04H 20/63 345/502
2011/0125366 A1* 5/2011 Bertosa ..... G07C 5/0808 701/31.4
2012/0130583 A1* 5/2012 Bertosa ..... G07C 5/0808 701/31.4
2013/0261882 A1* 10/2013 Bertosa ..... G07C 5/0808 701/33.2
2014/0325571 A1* 10/2014 De Lissandri ..... H04H 20/63 725/74

* cited by examiner

*Primary Examiner* — Orlando Bousono
(74) *Attorney, Agent, or Firm* — Rosenberg, Klein & Lee

(57) ABSTRACT

An automotive on-board diagnostic (OBD) computer system with an audiovisual guiding function includes an OBD main unit and a transmission connector. The OBD main unit includes a transmission port, a control unit, a receiving unit, a guide light, a sound unit, and a first sensing unit. The transmission connector includes a control module, an illumination unit, a transmitting unit, and a second sensing unit. Once activated, the control module not only turns on the illumination unit to provide illumination light, but also drives the transmitting unit to send a control signal to the receiving unit of the transmission port, in order for the control unit to turn on the guide light and the sound unit according to the control signal. The guiding light and instruction sound provided respectively by the guide light and the sound unit can help the user locate the transmission port.

6 Claims, 6 Drawing Sheets

AUTOMOTIVE ON-BOARD DIAGNOSTIC COMPUTER SYSTEM WITH AUDIOVISUAL GUIDING FUNCTION

BACKGROUND OF THE INVENTION

1. Technical Field

The present invention relates to an automotive on-board diagnostic computer system and more particularly to one that has an audiovisual guiding function to facilitate connection between a data link connector and a corresponding transmission connector.

2. Description of Related Art

Nowadays, it is not uncommon for a vehicle to be equipped with an on-board diagnostic (OBD) system. An automotive OBD system is typically connected to an on-board computer in order to obtain the execution status, settings, or like data of the on-board computer. In addition, an automotive OBD system includes a transmission port, generally known as data link connector (DLC), for connecting with the transmission connector of a display device or external computer, through which the owner of a vehicle or a technician can know the conditions of the vehicle. As the transmission port of an automotive OBD system is in most cases located at an spot below the dashboard of a vehicle, and the location of the transmission port may vary from one vehicle manufacturer to another, a user may have problem finding the transmission port rapidly, let alone aligning a transmission connector with it. In other words, the transmission ports of the conventional automotive OBD systems cause inconvenience of use.

As a solution, US Patent Application Publication No. 20150081163 A1, titled "OBD ILLUMINATOR CABLE APPARATUS AND METHOD", discloses a transmission connector that includes a housing, a plurality of pins, and a light source. The housing has an interface, from which the pins extend. The light source is disposed on the housing and provides illumination so that a user may find it easier to locate the transmission port of an automotive OBD system.

However, despite the illumination of the light source of the transmission connector, the user may still have to spend a lot of time looking for the transmission port because the location of the transmission port may vary with the vehicle manufacturer. The difficulty of finding the transmission port increases when the ambient light is so bright (e.g., during the day) that it interferes with the illumination of the light source.

BRIEF SUMMARY OF THE INVENTION

In an attempt to facilitate connection between the transmission port of an automotive OBD system and the transmission connector of an external device (e.g., a screen or external computer), the inventor of the present invention provides an automotive OBD computer system having an audiovisual guiding function. The automotive OBD computer system includes an OBD main unit and a transmission connector. The OBD main unit includes a transmission port, a control unit, a receiving unit, a guide light, a sound unit, and a first sensing unit. The control unit is connected to the receiving unit, the guide light, the sound unit, and the first sensing unit. Both the guide light and the sound unit are located at the transmission port. The transmission connector includes a control module, an illumination unit, a transmitting unit, and a second sensing unit. The control module is connected to the illumination unit, the transmitting unit, and the second sensing unit. Once activated, the control module turns on the illumination unit and drives the transmitting unit to send a control signal to the receiving unit of the transmission port, in order for the control unit to turn on the guide light and the sound unit according to the control signal. Each of the first sensing unit and the second sensing unit generates a sensing signal when sensing that the transmission connector is connected to the transmission port or is within a predetermined installation distance from the transmission port, in order for the control module to turn off the illumination unit according to the sensing signal and for the control unit to turn off the sound unit. When sensing that the transmission connector is detached from the transmission port, the first sensing unit generates a second sensing signal so that the control unit turns off the guide light.

Preferably, both the transmission port and the transmission connector comply with the J1962 DLC specification, and the transmission connector further includes a plurality of pins, an electricity storage unit, and a charging module. The electricity storage unit is connected to the control module. The charging module is connected to the electricity storage unit and two of the pins of the transmission connector so that the electricity storage unit can be charged with the electricity of a vehicle when the transmission connector is connected to the transmission port.

Preferably, the transmission port further includes a plurality of insertion holes to connect with the pins respectively, and the guide light is located in a peripheral area of the pins and provides flickering light as guiding light.

The first sensing unit is preferably a contact switch, a microswitch, a pressure sensor, or a distance sensor; and the second sensing unit is preferably a contact switch, a microswitch, a pressure sensor, or a distance sensor.

Preferably, the receiving unit and the transmitting unit jointly form a transceiver module, and the transceiver module is an infrared transceiver module, an ultrasonic transceiver module, or a radio frequency (RF) transceiver module.

The present invention also provides an automotive OBD computer system having an audiovisual guiding function and including the OBD main unit and the transmission connector defined below. The OBD main unit includes a transmission port, a control unit, a receiving unit, a guide light, and a sound unit. The control unit is connected to the receiving unit, the guide light, and the sound unit. Both the guide light and the sound unit are located at the transmission port. The transmission connector includes a control module, an illumination unit, and a transmitting unit. The control module is connected to the illumination unit and the transmitting unit. Once activated, the control module turns on the illumination unit and drives the transmitting unit to send a control signal to the receiving unit of the transmission port, in order for the control unit to turn on the guide light and the sound unit according to the control signal.

The technical features described above produce the following advantageous effect:

1. In addition to the illumination light provided by the transmission connector, the transmission port provides guiding light and an instruction sound to help the user find the transmission port rapidly. Therefore, even if the ambient light outshines the illumination light of the transmission connector, the user can still locate the transmission port with the assistance of the guiding light and the instruction sound.

2. The first sensing unit and the second sensing unit serve to sense whether the transmission connector is adjacent or connected to the transmission port, with a view to turning off the illumination light and the instruction sound automatically to avoid unnecessary interference with the user.

3. After the illumination light and the instruction sound are automatically turned off, the guiding light of the transmission port remains so that the transmission connector can be subsequently detached with ease.

4. The transmission connector can be supplied with the electricity it needs by being charged through the charging module with the electricity of a vehicle, and the charging process can be carried out conveniently.

DETAILED DESCRIPTION OF THE INVENTION

The present invention incorporates the foregoing technical features into an automotive OBD computer system with an audiovisual guiding function. The major effects of the automotive OBD computer system will be detailed below with reference to an illustrative embodiment.

Figure 1:
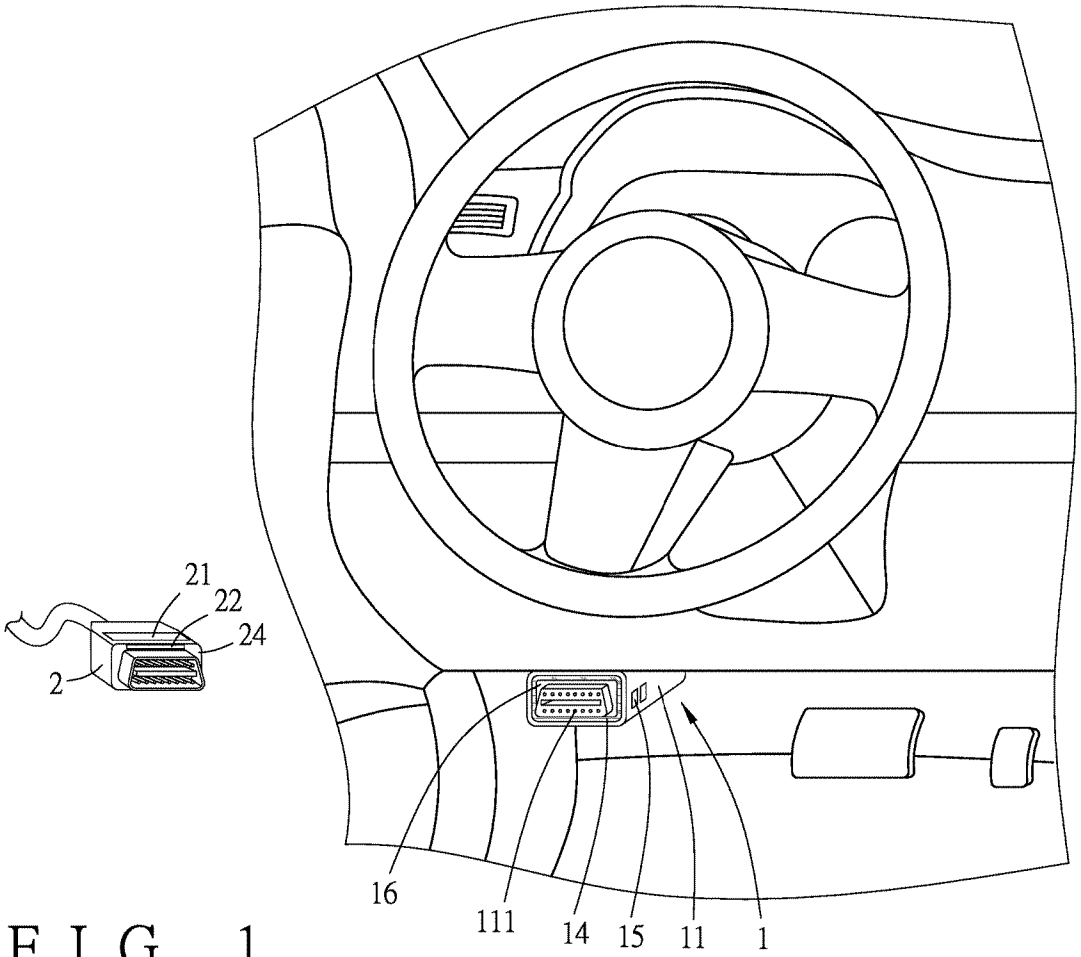
FIG. 1 schematically shows the system structure of an embodiment of the present invention.
Figure 2:
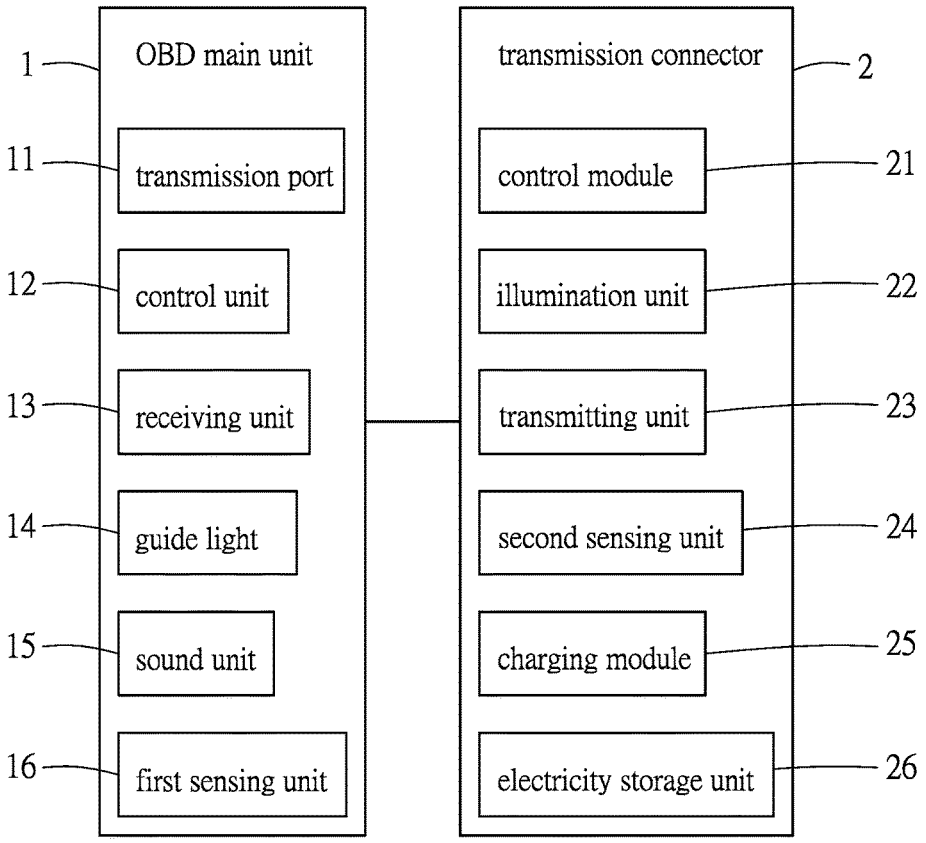
FIG. 2 is a system block diagram of the embodiment in FIG. 1.

Referring to FIG. 1 and FIG. 2, the automotive OBD computer system with an audiovisual guiding function according to an embodiment of the present invention includes an OBD main unit 1 and a transmission connector 2.

The OBD main unit 1 includes a transmission port 11, a control unit 12, a receiving unit 13, a guide light 14, a sound unit 15, and a first sensing unit 16. The control unit 12 is connected to the receiving unit 13, the guide light 14, the sound unit 15, and the first sensing unit 16. The transmission port 11 includes a plurality of insertion holes 111. Both the guide light 14 and the sound unit 15 are located at the transmission port 11. The first sensing unit 16 is, for example, a contact switch, a microswitch, a pressure sensor, or a distance sensor. Preferably, the guide light 14 is located in a peripheral area of the insertion holes 111 and flickers in order to provide clearly visible guiding light.

With continued reference to FIG. 1 and FIG. 2, the transmission connector 2 can be connected to the transmission port 11 in order to transmit data from the OBD main unit 1 to a screen, external computer, or like electronic device (not shown). The transmission connector 2 includes a control module 21, an illumination unit 22, a transmitting unit 23, and a second sensing unit 24. The control module 21 is connected to the illumination unit 22, the transmitting unit 23, and the second sensing unit 24. Once activated, the control module 21 turns on the illumination unit 23 and drives the transmitting unit 23 to send out a control signal. The transmitting unit 23 is preset to transmit signals to the receiving unit 13. The second sensing unit 24 is, for example, a contact switch, a microswitch, a pressure sensor, or a distance sensor. More specifically, the receiving unit 13 and the transmitting unit 23 joint form a transceiver module, which can be an infrared transceiver module, an ultrasonic transceiver module, or a radio frequency (RF) transceiver module.

Figure 3:
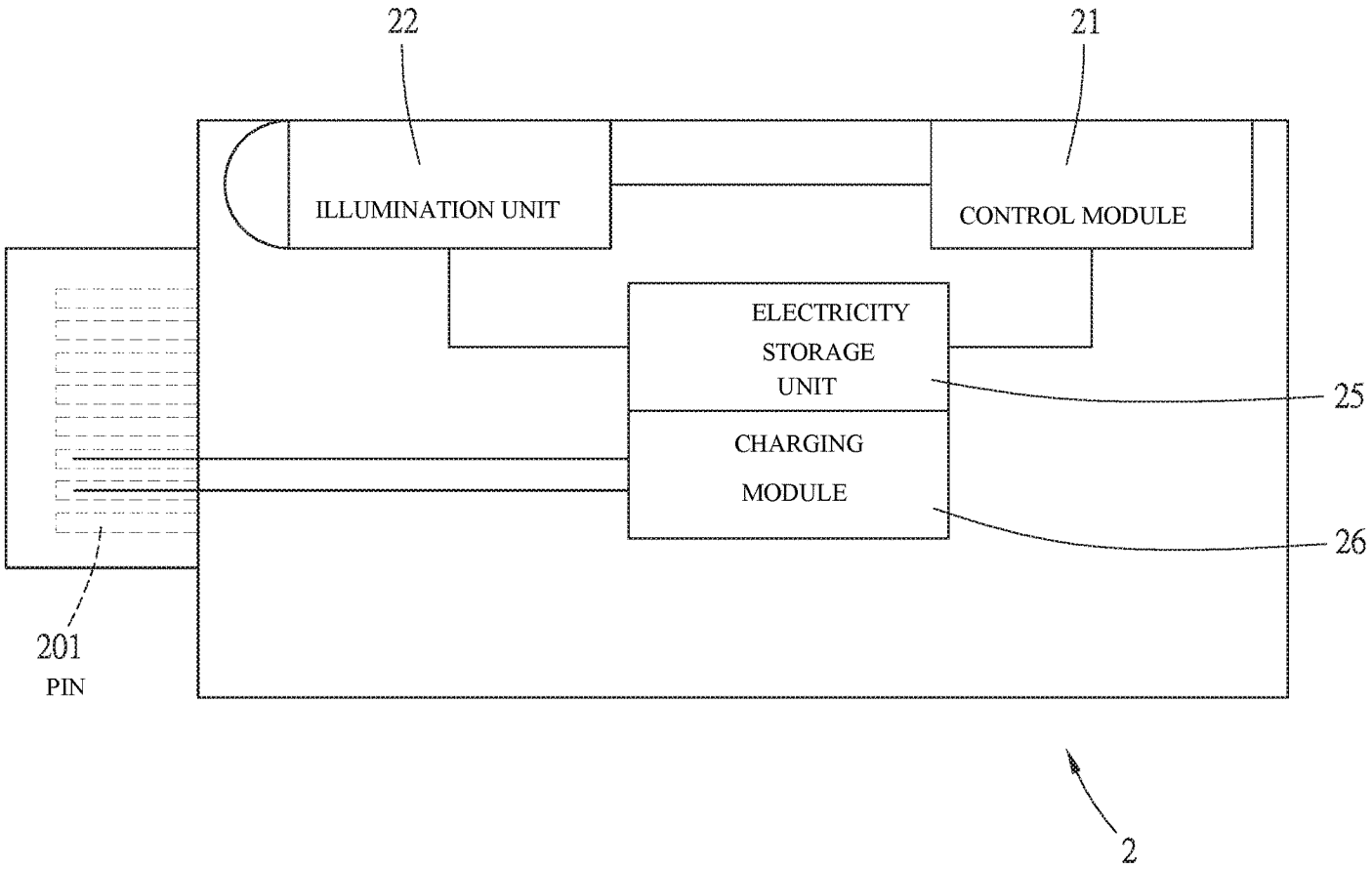
FIG. 3 is a schematic plan view of the transmission connector in the embodiment in FIG. 1, showing in particular the relationship between the electricity storage unit, the charging module, and the pins.

Preferably, referring to FIG. 2 and FIG. 3, both the transmission port 11 and the transmission connector 2 comply with the J1962 DLC specification, and the transmission connector 2 further includes a plurality of pins 201, an electricity storage unit 25, and a charging module 26. The electricity storage unit 25 is connected to the control module 21. The charging module 26 is connected to the electricity storage unit 25 and two of the pins 201 (e.g., pin 4 and pin 16) of the transmission connector 2 so that the electricity storage unit 25 can be charged with the electricity of a vehicle when the transmission connector 2 is connected to the transmission port 11. In practice, however, the charging arrangement can be dispensed with, and electricity can be supplied to the transmission connector 2 from a battery instead.

Figure 4:
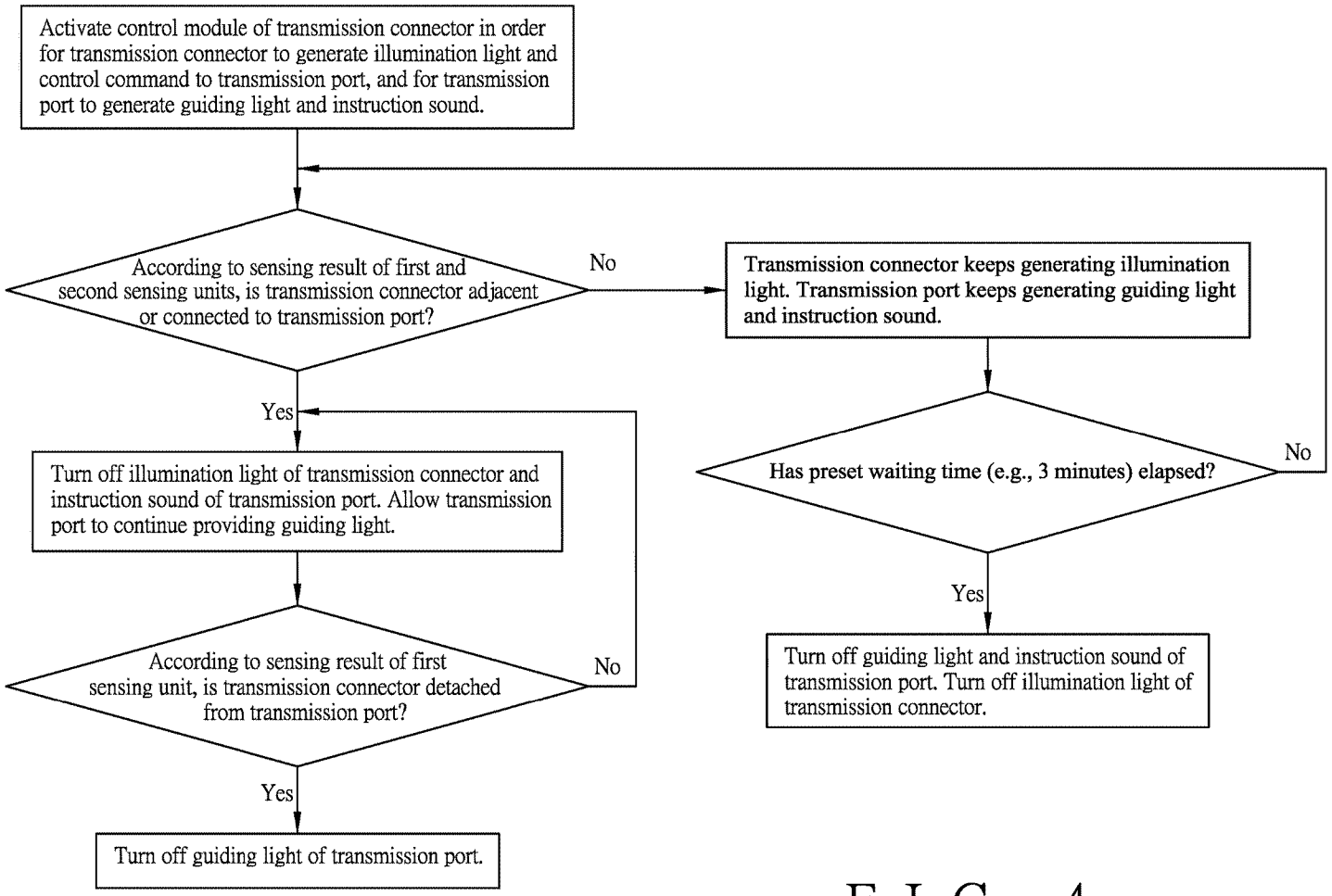
FIG. 4 is a flowchart showing the steps of using the embodiment in FIG. 1.
Figure 5:
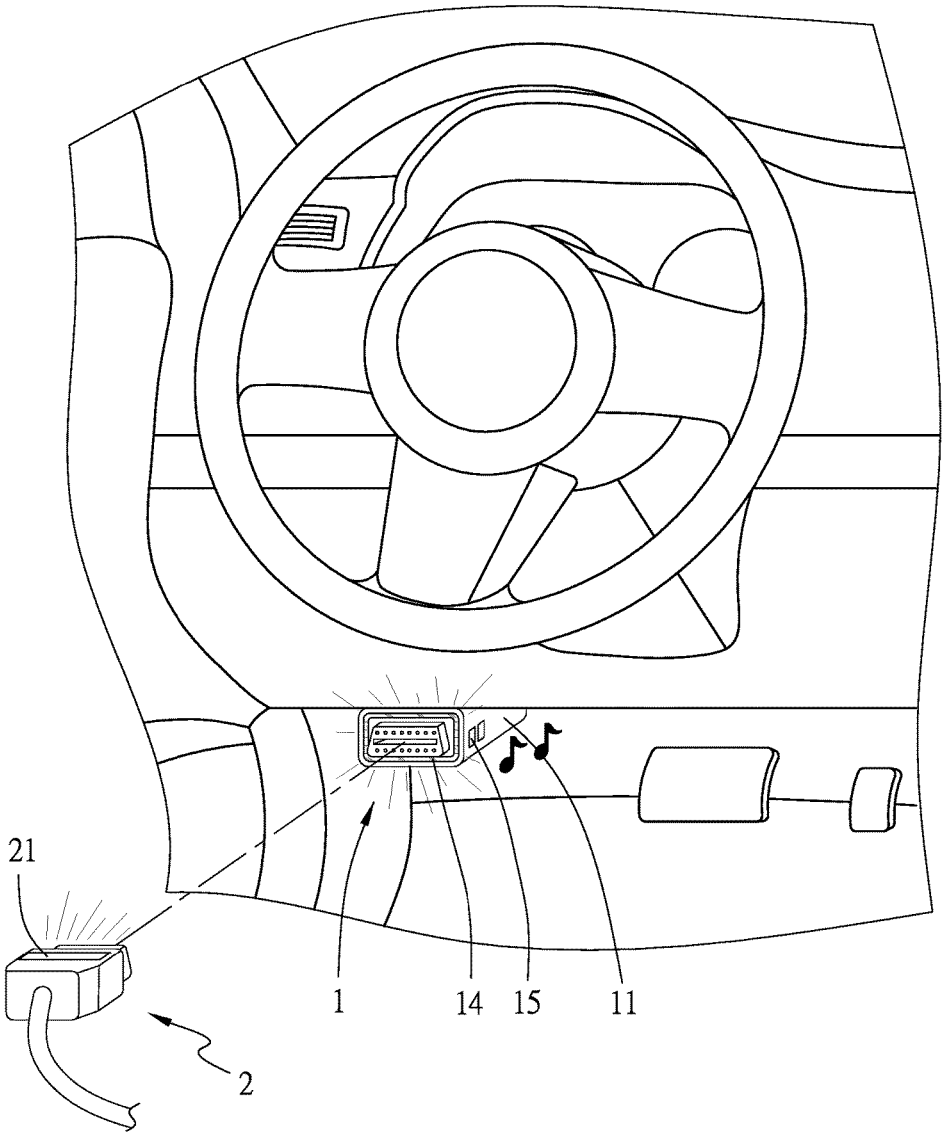
FIG. 5 schematically shows a state of use of the embodiment in FIG. 1, in particular how the transmission connector generates illumination light and how the transmission port generates guiding light and an instruction sound.

The steps of using the automotive OBD computer system are shown in the flowchart in FIG. 4. To begin with, step A is performed as described below with reference to FIG. 5 in conjunction with FIG. 2.

In step A, the user activates the control module 21 of the transmission connector 2 such that the illumination unit 22 of the transmission connector 2 generates illumination light. The control module 21 also generates a control signal, which is transmitted via the transmitting unit 23 to the receiving unit 13 of the OBD main unit 1. As a result, the control unit 12 of the OBD main unit 1 drives the guide light 14 to generate the guiding light and the sound unit 15 to generate an instruction sound (see FIG. 5). With the assistance of the guiding light and the instruction sound, the user will be able to locate the transmission port 11 rapidly.

Figure 6:
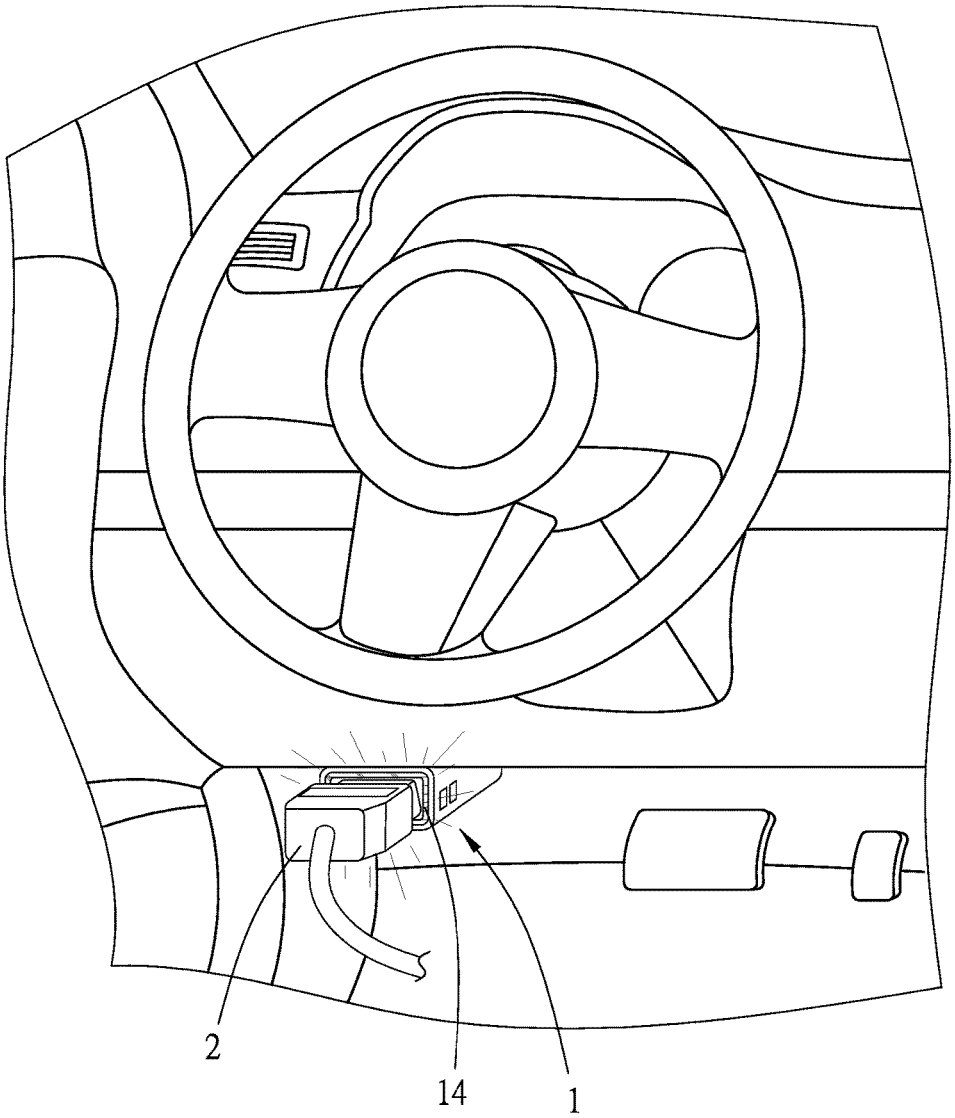
FIG. 6 schematically shows another state of use of the embodiment in FIG. 1, in particular how the transmission connector is connected to the transmission port.

After that, referring to FIG. 6 in conjunction with FIG. 2, step B is performed as follows. The user moves the transmission connector 2 toward the transmission port 11 while the first sensing unit 16 and the second sensing unit 24 sense whether or not the transmission connector 2 is within a predetermined installation distance (such as 0.5 cm) from the transmission port 11 or connected to the transmission port 11. If yes, the illumination unit 22 of the transmission connector 2 and the sound unit 15 of the transmission port 11 are turned off to stop the illumination light of the illumination unit 22 and the instruction sound of the sound unit 15. In the meantime, however, the guide light 14 keeps providing the guiding light so that the user can later detach the transmission connector 2 with ease. If no, the illumination unit 22 of the transmission connector 2 and the sound unit 15 of the transmission port 11 are left turned on for a certain period of time (hereinafter referred to as a waiting time, such as 3 minutes). If the transmission connector 2 remains outside the installation distance or unconnected with the transmission port 11 after the waiting time has elapsed, all of the illumination light, the instruction sound, and the guiding light will be turned off.

The sensing method of the first sensing unit 16 and the second sensing unit 24 is described in more detail below with reference to FIG. 2. When both the first sensing unit 16 and the second sensing unit 24 are contact switches, microswitches, or pressure sensors, the two sensing units 16 and 24 are respectively provided at the transmission port 11 and the transmission connector 2 at positions that correspond to each other so that the two sensing units 16 and 24 can face each other. Once the transmission connector 2 is connected to the transmission port 11, their respective contact switches, microswitches, or pressure sensors are triggered to generate a sensing signal to the control module 21 of the transmission connector 2 and a sensing signal to the control unit 12 of the OBD main unit 1 respectively, in order for the control module 21 and the control unit 12 to determine whether the transmission connector 2 is connected to the transmission port 11. When both the first sensing unit 16 and the second sensing unit 24 are distance sensors, they may include light (e.g., infrared or laser light) detection modules for detecting the distance between the transmission port 11 and the transmission connector 2, in order to generate sensing signals when the distance detected corresponds to the predetermined installation distance. It should be pointed out that the first sensing unit 16 and the second sensing unit 24 need not be sensors of the same type, provided that they can sense whether the transmission connector 2 is connected to, or within the predetermined installation distance from, the transmission port 11.

Next, referring to FIG. 6 in conjunction with FIG. 2, step C is carried out as follows. The first sensing unit 16 of the OBD main unit 1 senses whether the transmission connector 2 is detached from the transmission port 11. If yes, the guide light 14 of the OBD main unit 1 is turned off and therefore stops providing the guiding light. If no, provision of the guiding light continues.

The description of the foregoing embodiment should be able to enable a person of ordinary skill in the art to fully understand the operation, use, and effects of the present invention. The embodiment, however, is but a preferred one of the invention and is not intended to be restrictive of the scope of the invention. All simple, equivalent changes and modifications made according to the appended claims and the disclosure of this specification should fall within the scope of the present invention.

What is claimed is:

1. An automotive on-board diagnostic (OBD) computer system with an audiovisual guiding function, comprising:

an OBD main unit including a transmission port, a control unit, a receiving unit, a guide light, a sound unit, and a first sensing unit, wherein the control unit is connected to the receiving unit, the guide light, the sound unit, and the first sensing unit; and both the guide light and the sound unit are located at the transmission port; and a transmission connector including a control module, an illumination unit, a transmitting unit, and a second sensing unit, wherein the control module is connected to the illumination unit, the transmitting unit, and the second sensing unit; and upon activation, the control module turns on the illumination unit and drives the transmitting unit to send a control signal to the receiving unit of the transmission port, in order for the control unit to turn on the guide light and the sound unit according to the control signal;

wherein each of the first sensing unit and the second sensing unit generates a sensing signal when sensing that the transmission connector is connected to the transmission port or is within a predetermined installation distance from the transmission port, in order for the control module to turn off the illumination unit according to the sensing signal and for the control unit to turn off the sound unit; and the first sensing unit generates a second sensing signal when sensing that the transmission connector is detached from the transmission port, in order for the control unit to turn off the guide light.

2. The automotive OBD computer system of claim 1, wherein both the transmission port and the transmission connector comply with the J1962 DLC specification; the transmission connector further includes a plurality of pins, an electricity storage unit, and a charging module; the electricity storage unit is connected to the control module; and the charging module is connected to the electricity storage unit and two said pins of the transmission connector, thereby allowing the electricity storage unit to be charged with electricity of a vehicle when the transmission connector is connected to the transmission port.

3. The automotive OBD computer system of claim 2, wherein the transmission port further includes a plurality of insertion holes to connect with the pins respectively, and the guide light is located in a peripheral area of the pins and provides flickering light as guiding light.

4. The automotive OBD computer system of claim 1, wherein the first sensing unit is a contact switch, a microswitch, a pressure sensor, or a distance sensor.

5. The automotive OBD computer system of claim 4, wherein the second sensing unit is a contact switch, a microswitch, a pressure sensor, or a distance sensor.

6. The automotive OBD computer system of claim 1, wherein the receiving unit and the transmitting unit jointly form a transceiver module, and the transceiver module is an infrared transceiver module, an ultrasonic transceiver module, or a radio frequency (RF) transceiver module.

* * * * *